US008849173B2

(12) United States Patent
Kaneyama et al.

(10) Patent No.: US 8,849,173 B2
(45) Date of Patent: Sep. 30, 2014

(54) DEVELOPER COLLECTING DEVICE WHICH REDUCES CLOGGING OF FILTER AND IMAGE FORMING APPARATUS

(75) Inventors: Kiyotoshi Kaneyama, Kanagawa (JP); Masatoshi Yamada, Kanagawa (JP); Kazuyuki Yagata, Kanagawa (JP); Katsunori Kikuchihara, Kanagawa (JP); Yoshihiro Enomoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 13/086,192

(22) Filed: Apr. 13, 2011

(65) Prior Publication Data

US 2012/0107013 A1 May 3, 2012

(30) Foreign Application Priority Data

Nov. 2, 2010 (JP) ..... 2010-246434

(51) Int. Cl.

| | |
|---|---|
| ***G03G 21/00*** | (2006.01) |
| ***G03G 21/20*** | (2006.01) |
| ***G03G 15/16*** | (2006.01) |
| ***G03G 21/10*** | (2006.01) |
| ***G03G 21/12*** | (2006.01) |

(52) U.S. Cl.

CPC ..... *G03G 15/161* (2013.01); *G03G 21/105* (2013.01); *G03G 21/12* (2013.01)

USPC ..... 399/358; 399/92; 399/101

(58) Field of Classification Search

USPC ..... 399/101, 120, 358, 360, 92

See application file for complete search history.

(56) References Cited

U.S. PATENT DOCUMENTS

| | | | | |
|---|---|---|---|---|
| 4,583,112 | A * | 4/1986 | Morano et al. | 399/103 |
| 4,963,930 | A * | 10/1990 | Yoshimaru et al. | 399/103 |
| 5,983,052 | A * | 11/1999 | Fantuzzo et al. | 399/93 |
| 6,055,393 | A * | 4/2000 | Anderson et al. | 399/103 |
| 7,609,990 | B2 * | 10/2009 | Maeda et al. | 399/92 |
| 7,609,993 | B2 * | 10/2009 | Maeda et al. | 399/101 |
| 8,385,770 | B2 * | 2/2013 | Yamada et al. | 399/101 |
| 2007/0189802 | A1 * | 8/2007 | Maeda et al. | 399/101 |
| 2007/0230989 | A1 * | 10/2007 | Maeda et al. | 399/92 |
| 2011/0008068 | A1 * | 1/2011 | Kunihiro et al. | 399/92 |
| 2012/0114367 | A1 * | 5/2012 | Yagata et al. | 399/101 |

FOREIGN PATENT DOCUMENTS

JP 2007-171822 A 7/2007

* cited by examiner

*Primary Examiner* — G. M. Hyder

(74) *Attorney, Agent, or Firm* — Sughrue Mion, PLLC

(57) ABSTRACT

A developer collecting device includes a housing in which an opening disposed opposite to a developer holding member is formed, a collection member that is disposed to be capable of coming in contact with and being separated from the developer holding member and that detaches the developer and collects the detached developer in the housing, a sealing member that is disposed to be capable of coming in contact with and being separated from the developer holding member and that seals up a gap between the developer holding member and the housing, a suction passage to which a suction unit suctioning the developer into the housing is connected, a developer transport unit that transports the developer to one end of the housing, and a filtration member that is tilted so that at least an upper part thereof overlaps with the upside of the developer transport unit in a plan view.

9 Claims, 9 Drawing Sheets

DEVELOPER COLLECTING DEVICE WHICH REDUCES CLOGGING OF FILTER AND IMAGE FORMING APPARATUS

CROSS-REFERENCE TO RELATED APPLICATION

This application is based on and claims priority under 35 USC 119 from Japanese Patent Application No. 2010-246434 filed on Nov. 2, 2010.

BACKGROUND

Technical Field

The present invention relates to a developer collecting device and an image forming apparatus.

SUMMARY

According to an aspect of the invention, there is provided a developer collecting device including:

a housing in which an opening disposed opposite to a developer holding member moving with developer held thereon is formed to extend in a direction perpendicular to a moving direction of the developer holding member;

a collection member that is disposed along an edge of the opening downstream in the moving direction so as to be capable of coming in contact with and being separated from the developer holding member and that detaches the developer from an outer peripheral surface and collects the detached developer in the housing at the time of coming in contact with the outer peripheral surface of the developer holding member;

a sealing member that is disposed along an edge of the opening upstream in the moving direction so as to be capable of coming in contact with and being separated from the developer holding member and that seals up a gap between the developer holding member and the housing at the time of coming in contact with the outer peripheral surface of the developer holding member;

a suction passage that is formed in a length direction of the housing and to which a suction unit suctioning the developer detached from the developer holding member into the housing is connected;

a developer transport unit that transports the developer collected into the housing to one end in the length direction of the housing; and a filtration member that is disposed between the developer transport unit and the suction passage so as to extend in the length direction of the housing and that is tilted so that at least an upper part thereof overlaps with the upside of the developer transport unit in a plan view.

BRIEF DESCRIPTION OF THE DRAWINGS

Exemplary embodiment of the present invention will be described in detail based on the following figures, wherein.

DETAILED DESCRIPTION

Figure 1:
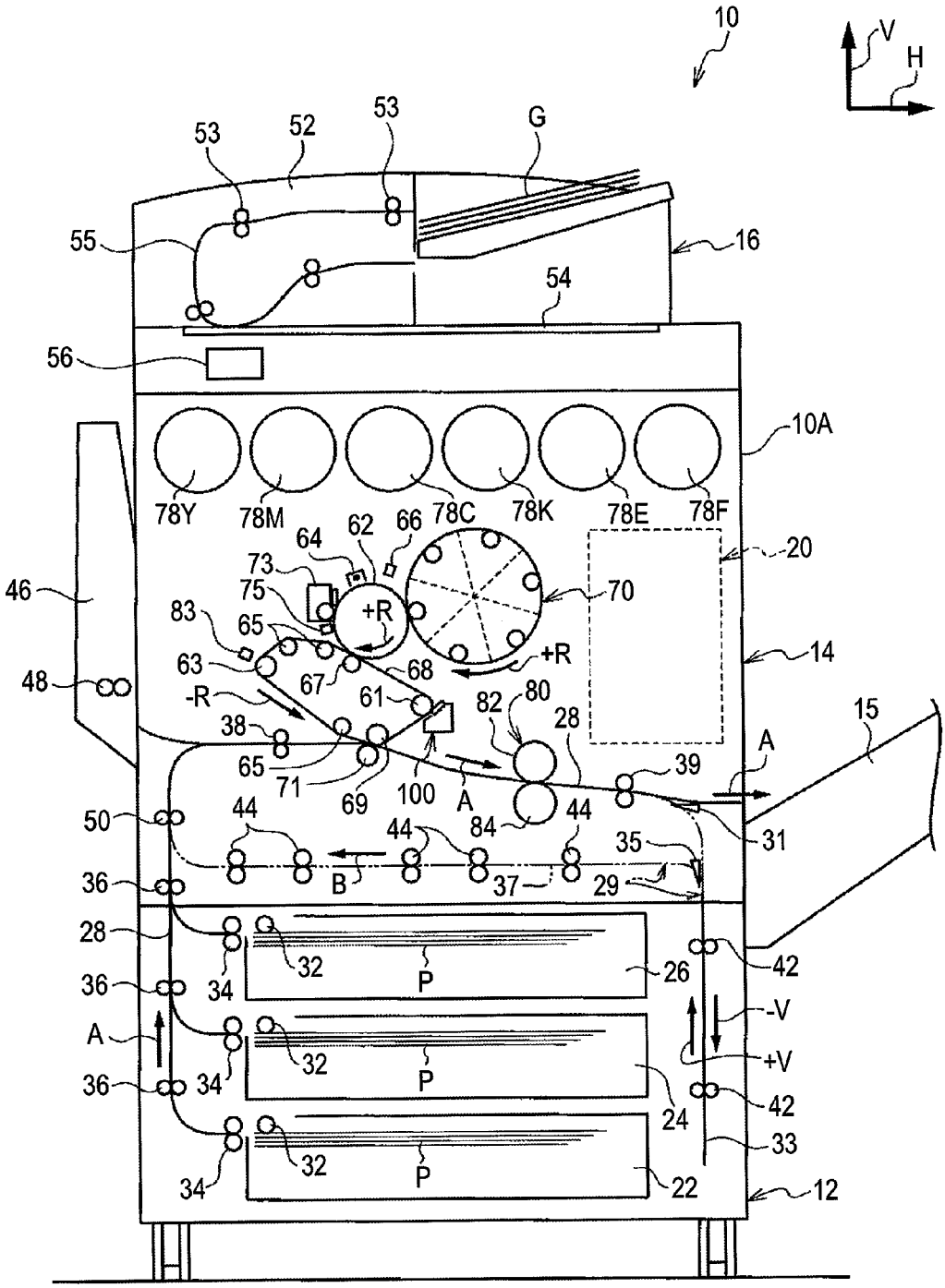
FIG. 1 is a diagram illustrating the entire configuration of an image forming apparatus according to an exemplary embodiment of the invention.

Hereinafter, exemplary embodiments of the invention will be described in detail with reference to the accompanying drawings. In FIG. 1, the direction of arrow V is defined as an upside direction (vertical direction) of an image forming apparatus 10 and the direction of arrow H is defined as a right direction (horizontal direction) of the image forming apparatus 10. The front side in a direction perpendicular to the drawing surface shown in FIG. 1 is defined as a front side and a front surface of the image forming apparatus 10. In this exemplary embodiment, recording sheets P are employed as an example of a recording medium, the upstream side in a carrying direction of a recording sheet P is also simply referred to as "upstream", the downstream side in the carrying direction is also simply referred to as "downstream".

As shown in FIG. 1, from the bottom side to the top side in the vertical direction, the image forming apparatus 10 includes a sheet receiving section 12 receiving recording sheets P, an image forming unit 14 that is disposed above the sheet receiving unit 12 and that forms an image on a recording sheet P fed from the sheet receiving section 12, a document reading unit 16 that is disposed above the image forming unit 14 and that reads a document G, and a controller 20 that is disposed in the image forming unit 14 and that controls the behavior of the units of the image forming apparatus 10.

The sheet receiving section 12 includes a first receiving section 22, a second receiving section 24, and a third receiving section 26 receiving recording sheets P having different sizes. Each of the first receiving section 22, the second receiving section 24, and the third receiving section 26 includes a pickup roller 32 picking up and sending out the recording sheets P received therein to a carrying path 28 in the image forming apparatus 10. The carrying path 28 downstream from the pickup rollers 32 is provided with pairs of carrying rollers 34 and 36 carrying the recording sheets P sheet by sheet.

A pair of carrying rollers 50 is disposed downstream from the carrying roller 36 of the third receiving section 26 so as to merge and carry a recording sheet P sent through a inverse carrying path 29 to be described later with the carrying path 28. A registration roller 38 that temporarily stops a recording sheet P and carries the recording sheet P to a secondary transfer position to be described later at a predetermined time.

In a front view of the image forming apparatus 10, the upstream carrying path 28 including the carrying roller 50 has a substantially linear shape in the vertical direction. The downstream carrying path 28 including the registration roller 38 has a linear shape from the left to the right of the image forming apparatus 14, that is, to a sheet discharge section 15 disposed on the right side surface of the apparatus body 10A. An inverse carrying path 29 through which a recording sheet P is switched back and carried is disposed below the downstream carrying path 28 including the registration roller 38.

The inverse carrying path 29 is provided with a first guide member 31 that guides a recording sheet P from the carrying path 28 to the inverse carrying path 29, an inversion section 33 that is disposed in a linear shape in the vertical direction to extend from the lower-right side of the image forming unit 14 to the lower-right side of the sheet receiving section 12, a second guide member 35 that guides the recording sheet P carried to the inversion section 33 from the inversion section 33 to a carrying section 37 to be described later, and a carrying section 37 that carries the recording sheet P guided by the second guide member 35.

The downstream side of the carrying section 37 is merged into the carrying path 28 between the carrying roller 36 of the third receiving section 26 and the carrying roller 50. Plural pairs of carrying rollers 42 are disposed in the inversion section 33 at predetermined intervals. Plural pairs of carrying rollers 44 are disposed in the carrying section 37 at predetermined intervals.

The first guide member 31 has a substantially triangular prism shape in a front view and the front end thereof is moved to one of the carrying path 28 and the inverse carrying path 29 by a driving unit not shown so as to guide the recording sheet P to the carrying path 28 or the inverse carrying path 29. Similarly, the second guide member 35 has a substantially triangular prism shape in a front view and the front end thereof is moved to one of the inversion section 33 and the carrying section 37 by a driving unit not shown so as to guide the recording sheet P to the inversion section 33 or the carrying section 37.

A foldable bypass tray 46 is disposed on the left side surface of the apparatus body 10A. A recording sheet P fed from the bypass tray 46 is carried by a carrying roller 48 and is merged into the carrying path 28 downstream from the carrying roller 50 and upstream from the registration roller 38.

The document reading unit 16 includes a document feeder 52 automatically feeding the document G sheet by sheet, a platen glass 54 that is disposed below the document feeder 52 and that has a sheet of document G placed thereon, and a document reader 56 that reads the document G fed by the document feeder 52 or the document G placed on the platen glass 54.

The document feeder 52 includes an automatic feeding path 55 having plural pairs of carrying rollers 53 arranged therein. A part of the automatic feeding path 55 is disposed so that the recording sheet P passes over the platen glass 54. The document reader 56 reads the document G fed by the document feeder 52 in a state where it is fixed to the left end of the platen glass 54 or reads the document G placed on the platen glass 54 while moving to the right side.

The image forming unit 14 includes a cylindrical photosensitive member 62 that is disposed substantially at the center of the apparatus body 10A and that is an example of a latent image holding member disposed with a direction directed from the front side to the back side of the apparatus body 10A as an axis direction. The photosensitive member 62 rotates in the direction of arrow +R (in the clockwise direction in the drawing) by a driving unit not shown and holds an electrostatic latent image formed by the application of light. A corotron type charging member 64 that charges the outer peripheral surface of the photosensitive member 62 is disposed at a position above the photosensitive member 62 and opposite to the outer peripheral surface (surface) of the photosensitive member 62.

An exposure device 66 is disposed at a position downstream in the rotating direction of the photosensitive member 62 from the charging member 64 and opposite to the outer peripheral surface of the photosensitive member 62. The exposure device 66 includes an LED (Light Emitting Diode) and applies light to (exposes) the outer peripheral surface of the photosensitive member 62 charged by the charging member 64 on the basis of image signals corresponding to toner colors to form electrostatic latent images.

The exposure device 66 is not limited to the LED type, but may apply a laser beam, for example, by the use of a polygon mirror. A rotary switching type developing device 70 as an example of a developing unit that develops the electrostatic latent images formed on the outer peripheral surface of the photosensitive member 62 with predetermined toner colors to form visible images is disposed downstream in the rotating direction of the photosensitive member 62 from the portion to which light is applied by the exposure device 66. Details of the developing device 70 will be described later.

An intermediate transfer unit 60 (see FIG. 2) to which the toner images (developer images) formed on the outer peripheral surface of the photosensitive member 62 is primarily transferred is disposed downstream in the rotating direction of the photosensitive member 62 from the developing device 70 and below the photosensitive member 62. The intermediate transfer unit 60 includes an endless intermediate transfer belt (intermediate transfer member) 68 as an example of a developer holding member that circularly moves in the direction of arrow −R (in the counterclockwise direction in the drawing).

The intermediate transfer belt 68 is wound on a driving roller 61 that is rotationally driven by the controller 20, a tension-applying roller 63 that applies a tension to the intermediate transfer belt 68, plural carrying rollers 65 that come in contact with the inner peripheral surface (rear surface) of the intermediate transfer belt 68 to rotate therewith, and an auxiliary roller 69 that comes in contact with the inner peripheral surface of the intermediate transfer belt 68 at a secondary transfer position to be described later to rotate therewith.

A primary transfer roller 67 that primarily transfers the toner images formed on the outer peripheral surface of the photosensitive member 62 onto the outer peripheral surface (front surface) of the intermediate transfer belt 68 is disposed on the opposite side of the photosensitive member 62 with the intermediate transfer belt 68 interposed therebetween.

The primary transfer roller 67 comes in contact with the inner peripheral surface of the intermediate transfer belt 68 at a position separated downstream in the moving direction of the intermediate transfer belt 68 from the position where the photosensitive member 62 comes in contact with the intermediate transfer belt 68. The primary transfer roller 67 is supplied with power from a power supply not shown to primarily transfer the toner images on the photosensitive member 62 onto the outer peripheral surface of the intermediate transfer belt 68 on the basis of the potential difference from the photosensitive member 62 grounded.

A secondary transfer roller 71 as an example of a transfer unit that secondarily transfers the toner images primarily transferred onto the outer peripheral surface of the intermediate transfer belt 68 onto the recording sheet P is disposed on the opposite side of the auxiliary roller 69 with the intermediate transfer belt 68 interposed therebetween. The position between the secondary transfer roller 71 and the auxiliary roller 69 is defined as a secondary transfer position where the toner images are transferred to the recording sheet P. The secondary transfer roller 71 is configured to come in contact with and to be separated from the outer peripheral surface of the intermediate transfer belt 68 by the use of a retraction mechanism not shown.

That is, the secondary transfer roller 71 is separated from the outer peripheral surface until the toner images of colors are primarily transferred onto the outer peripheral surface of the intermediate transfer belt 68, comes in contact with the outer peripheral surface when the toner images of colors are primarily transferred onto the outer peripheral surface of the intermediate transfer roller 68, and secondarily transfers the toner images on the outer peripheral surface of the intermediate transfer belt 68 onto the recording sheet P with the potential difference from the auxiliary roller 69 grounded by supplying power thereto from a power supply not shown.

A cleaning device 100 as an example of a developer collecting device that collects residual toner T (see FIGS. 9A and 9B) remaining on the outer peripheral surface of the intermediate transfer belt 68 after the secondary transfer is disposed on the opposite side of the driving roller 61 with the intermediate transfer belt 68 interposed therebetween. Details of the cleaning device 100 will be described later.

A position detecting sensor 83 that detects a predetermined reference position on the outer peripheral surface of the intermediate transfer belt 68 by sensing a mark (not shown) attached to the outer peripheral surface of the intermediate transfer belt 68 and outputs a position detecting signal as a reference of an image forming process start time is disposed at a position opposite to the tension-applying roller 63 around the intermediate transfer belt 68.

A cleaning device 73 that removes residual toner not primarily transferred onto the outer peripheral surface of the intermediate transfer belt 68 but remaining on the outer peripheral surface of the photosensitive member 62 is disposed downstream in the rotating direction of the photosensitive member 62 from the primary transfer roller 67.

Figure 2:
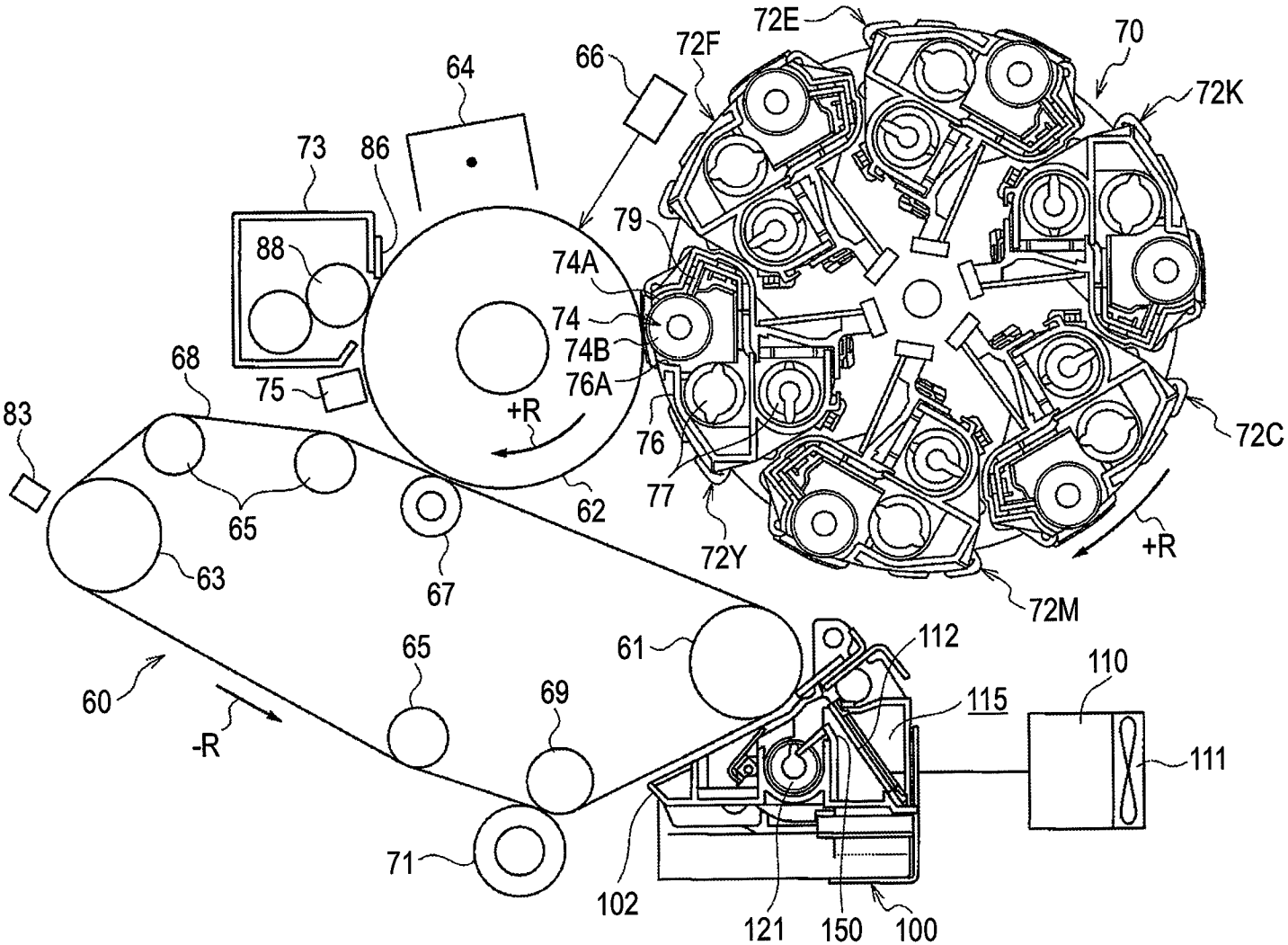
FIG. 2 is a diagram illustrating the configuration of an image forming unit according to the exemplary embodiment.

As shown in FIG. 2, the cleaning device 73 is configured to collect the residual toner by the use of a cleaning blade 86 and a brush roller 88 coming in contact with the outer peripheral surface of the photosensitive member 62. A neutralization device 75 that applies light onto the outer peripheral surface of the photosensitive member 62 to neutralize the outer peripheral surface is disposed upstream (downstream from the primary transfer roller 67) in the rotating direction of the photosensitive member 62 from the cleaning device 73.

The neutralization device 75 neutralizes the outer peripheral surface of the photosensitive member 62 by applying light to the outer peripheral surface before the cleaning device 73 collects the residual toner, whereby the adhesive force of the residual toner due to the static electricity is reduced to enhance the collection rate of the residual toner. The neutralization device that neutralizes the outer peripheral surface of the photosensitive member 62 from which the residual toner has been collected may be disposed downstream in the rotating direction of the photosensitive member 62 from the cleaning device 73 and upstream from the charting member 64.

As shown in FIG. 1, the secondary transfer position of the toner images transferred by secondary transfer roller 71 is set to halfway of the carrying path 28 and a fixing device 80 that fixes the toner images onto the recording sheet P having the toner images transferred thereto by the secondary transfer roller 71 is disposed downstream in the carrying direction (indicated by arrow A) of the recording sheet P from the secondary transfer roller 71 in the carrying path 28.

The fixing device 80 includes a heating roller 82 that has a heat source emitting heat with the supply of power and that is disposed to face the toner image face (upper side) of the recording sheet P and a pressurizing roller 84 that is disposed below the heating roller 82 and that presses the recording sheet P to the outer peripheral surface of the heating roller 82. A carrying roller 39 that carries the recording sheet P to the sheet discharge section 15 or the inversion section 33 is disposed downstream in the carrying direction of the recording sheet P from the fixing device 80 in the carrying path 28.

Toner cartridges 78Y, 78M, 78C, 78K, 78E, and 78F that contain toner of yellow (Y), magenta (M), cyan (C), black (K), a first special color (E), and a second special color (F) are replaceably arranged in the horizontal direction below the document reader 56 and above the developing device 70.

The first special color E and the second special color F are selected from special colors (including a transparent color) other than yellow, magenta, cyan, and black, or are not selected. The developing device 70 forms an image using six colors of Y, M, C, K, E, and F when the first special color E and the second special color F are selected, and forms an image using four colors of Y, M, C, and K when the first special color E and the second special color F are not selected.

In this exemplary embodiment, it is described, for example, that an image is formed using four colors of Y, M, C, and K and the first special color E and the second special color F are not used. However, an image may be formed using five colors of four colors of Y, M, C, and K and the first special color E or the second special color F.

The developing device 70 will be described below.

As shown in FIG. 2, the developing device 70 includes developing units 72Y, 72M, 72C, 72K, 72E, and 72F corresponding to the toner colors of yellow (Y), magenta (M), cyan (C), black (K), the first special color (E), and the second special color (F). The developing units 72Y to 72F are arranged in the peripheral direction (sequentially in the counterclockwise direction) and rotate by a central angle of 60° by the use of a motor (not shown) as a rotational driving source, whereby the developing units 72Y, 72M, 72C, 72K, 72E, and 72F performing the developing process are switched to face the outer peripheral surface of the photosensitive member 62.

Since the developing units 72Y, 72M, 72C, 72K, 72E, and 72F have the same configuration, only the developing unit 72Y will be described herein and the other developing units 72M, 72C, 72K, 72E, and 72F will not be described.

The developing unit 72Y includes a case member 76 as a body and the case member 76 is filled with developer (not shown) including toner and carrier supplied from the toner cartridge 78Y (see FIG. 1) via a toner supply path (not shown).

A rectangular opening 76A facing the outer peripheral surface of the photosensitive member 62 is formed in the case member 76 and a developing roller 74 of which the outer peripheral surface faces the outer peripheral surface of the photosensitive member 62 is disposed in the opening 76A. A plate-like regulating member 79 that regulates the thickness of developer is disposed along the length direction of the opening 76A at a portion close to the opening 76A in the case member 76.

The developing roller 74 includes a cylindrical developing sleeve 74A disposed to be rotatable and a magnetic member 74B having plural magnetic poles fixed to the inside of the developing sleeve 74A. A magnetic brush of developer (carrier) is formed with the rotation of the developing sleeve 74A and the thickness thereof is regulated by the regulating member 79 to form a developer layer on the outer peripheral surface of the developing sleeve 74A. The developer layer on the outer peripheral surface of the developing sleeve 74A is carried to a position facing the photosensitive member 62 and attaches toner corresponding to the latent image (electrostatic latent image) formed on the outer peripheral surface of the photosensitive member 62 thereto to perform a developing operation.

Two transport augers 77 formed in a spiral shape are rotatably arranged in parallel in the case member 76. With the rotation of two transport augers 77, the developer filled in the case member 76 is circularly transported in the axis direction (in the length direction of the developing unit 72Y) of the developing roller 74.

Six developing rollers 74 disposed in the developing units 72Y, 72M, 72C, 72K, 72E, and 72F are arranged in the peripheral direction so that the interval between the neighboring developing rollers 74 is a central angle of 60°. The next developing roller 74 is made to face the outer peripheral surface of the photosensitive member 62 by the switching of the developing units 72.

The cleaning device 100 will be described below.

As shown in FIGS. 2 to 4B, the cleaning device 100 includes a housing 102 having a rectangular opening 104 formed opposite to the intermediate transfer belt 68, a cleaning blade 106 as an example of a collection member that is disposed above the opening 104 and that comes in contact with the intermediate transfer belt 68 to collect the residual toner T, and a sealing member 108 as an example of a sealing member that is disposed in the opening 104 at the opposite position of (below) the cleaning blade 106 and that comes in contact with the intermediate transfer belt 68 to seal the gap between the housing 102 and the intermediate transfer belt 68.

In describing the arrangement of the members of the housing 102 below, the length direction of the housing 102 and the opening 104 is defined as a direction of arrow Z, the direction which is perpendicular to the direction of arrow Z and which is an in-plane direction of the bottom wall 102A of the housing 102 is defined as a direction of arrow X, and the height direction of the housing 102 perpendicular to the direction of arrow X and the direction of arrow Z is defined as a direction of arrow Y. The direction of arrow Z is a direction directed from the front side to the back side in the front view of the image forming apparatus 10 (see FIG. 1).

Figure 3A:
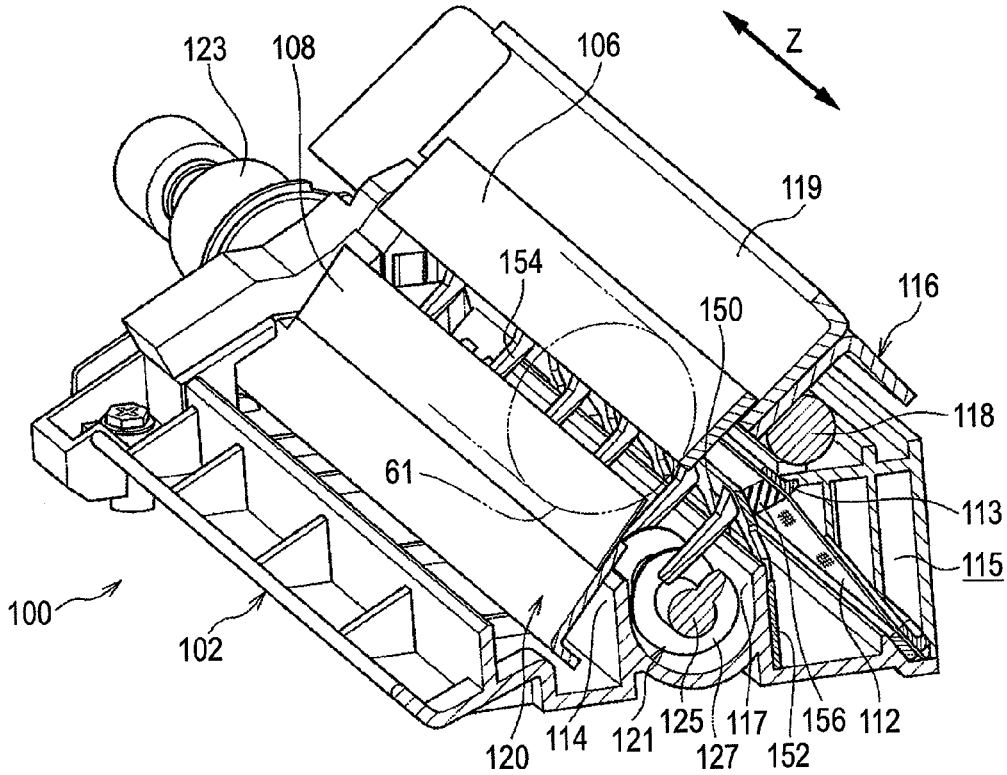
FIG. 3A is a perspective view illustrating the internal configuration of a cleaning device at the time of coming in contact with an intermediate transfer belt and FIG. 3B is a sectional view illustrating the internal configuration of the cleaning device at the time of coming in contact with the intermediate transfer belt.
Figure 3B:
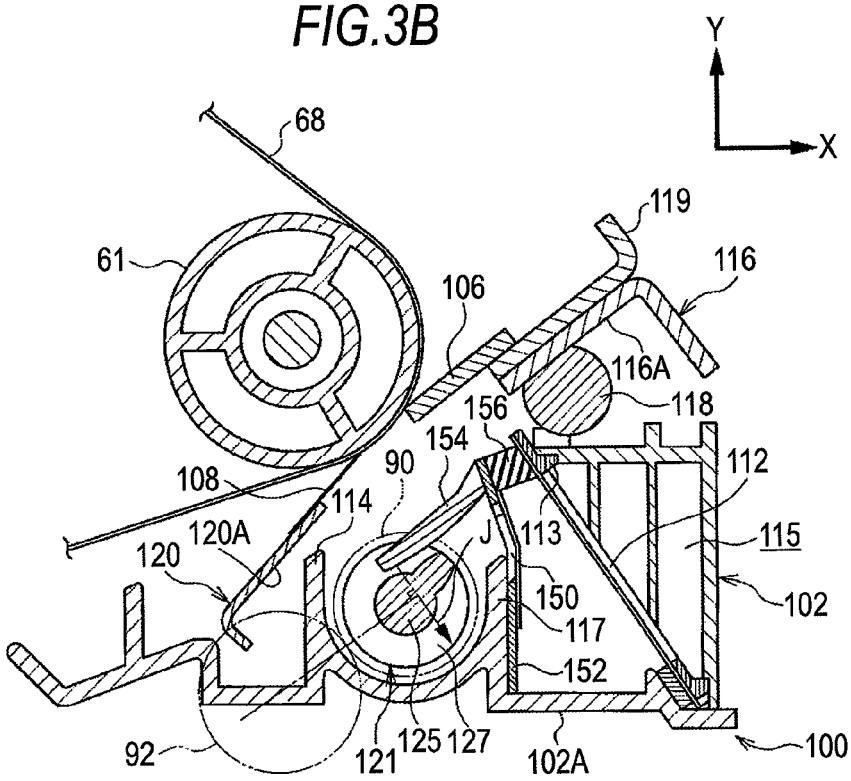
Figure 4A:
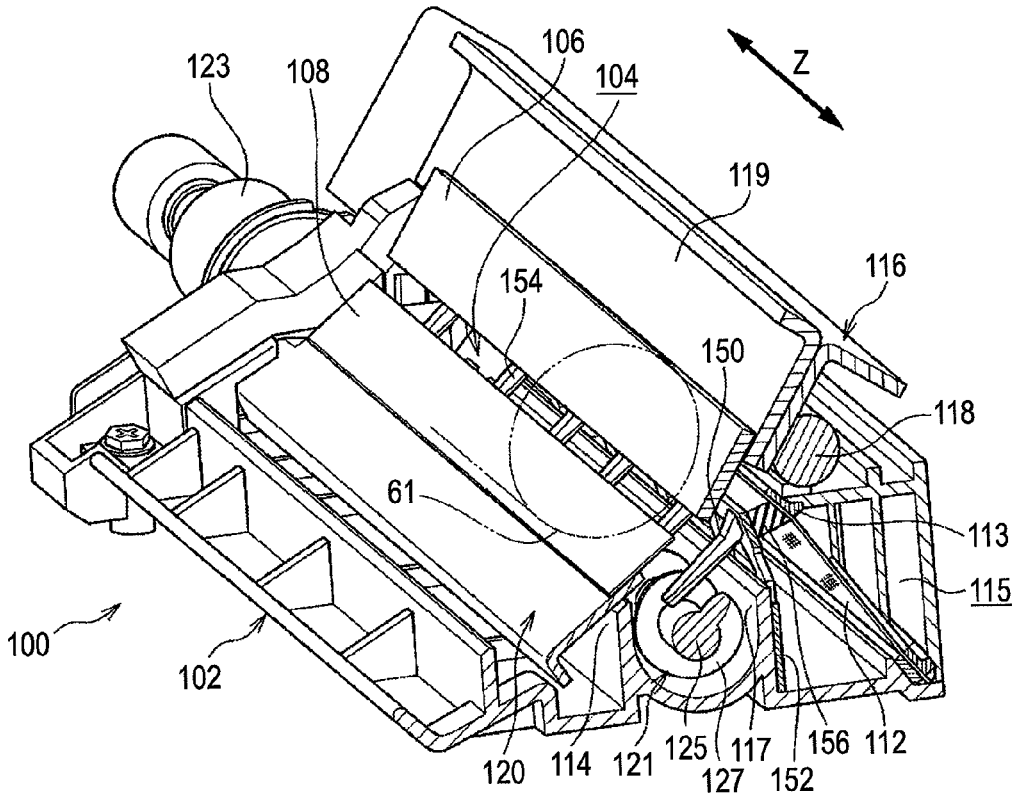
FIG. 4A is a perspective view illustrating the internal configuration of the cleaning device at the time of being separated from the intermediate transfer belt and FIG. 4B is a sectional view illustrating the internal configuration of the cleaning device at the time of being separated from the intermediate transfer belt.
Figure 4B:
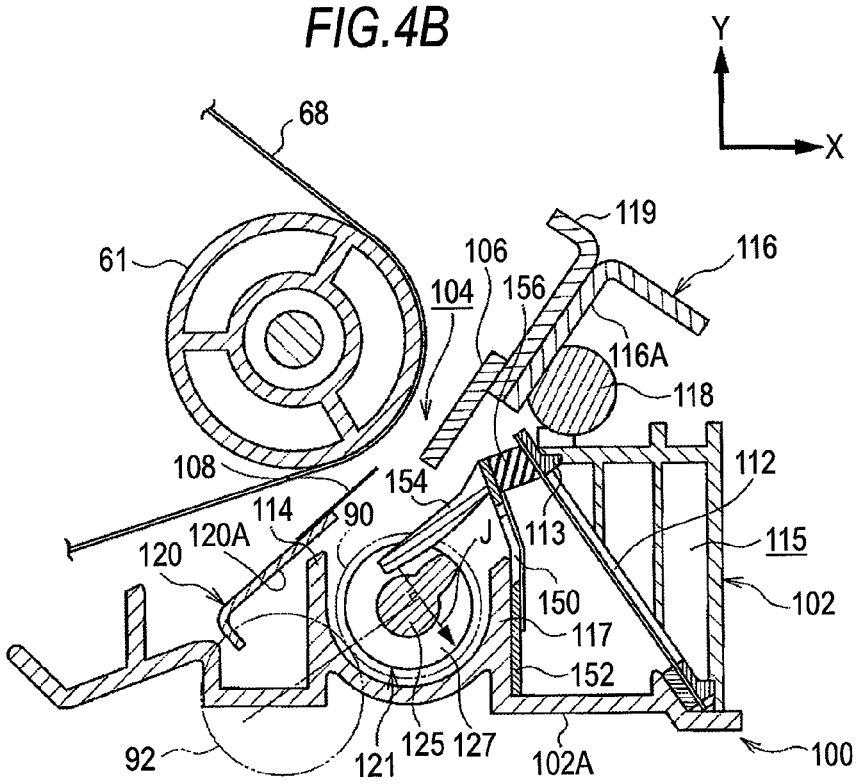

As shown in detail in FIGS. 3A and 3B and FIGS. 4A and 4B, a first movable member 116 formed of an L-shaped metal sheet in the XY plane with the direction of arrow Z as the length direction is disposed in the upper portion of the housing 102. FIGS. 3A and 3B show a state where the cleaning blade 106 and the sealing member 108 come in contact with the intermediate transfer belt 68 and FIGS. 4A and 4B show a state where the cleaning blade 106 and the sealing member 108 are separated from the intermediate transfer belt 68.

The first movable member 116 is disposed in a chevron shape in the XY plane and a spindle 118 with the direction of arrow Z as an axis direction thereof is fixed to the rear side (the side close to a suction path 115 to be described later) of one tilted portion 116A (the portion tilted to the lower-left side in the drawings). Both ends of the spindle 118 are rotatably supported by a bearing (not shown).

A support plate 119 formed of an L-shaped metal sheet in the XY plane is attached to the front surface of the tilted portion 116A of the first movable member 116. One end in the transverse direction (downstream in the moving direction) of the cleaning blade 106 disposed in the tilt direction of the tilted portion 116A is fixed to the lower end of the support plate 119 by adhesion.

The cleaning blade 106 is formed of a resin plate having a rectangular shape in a plan view and is attached to the support plate 119 so that the length direction thereof is parallel to the length direction of the opening 104. That is, the cleaning blade 106 is disposed along an edge of the opening 104 downstream in the moving direction (the direction of arrow −R) of the intermediate transfer belt 68.

The cleaning blade 106 is disposed so that the free end thereof (the end not attached to the support plate 119) comes in contact with the intermediate transfer belt 68 when a retraction mechanism not shown is disposed in a contact state, whereby the residual toner T on the intermediate transfer belt 68 is collected into the housing 102.

A second movable member 120 formed of an L-shaped metal sheet with the direction of arrow Z as a length direction thereof is disposed in the lower side of the housing 102 in the XY plane. The second movable member 120 has a chevron shape in the XY plane and a spindle (not shown) that is rotatably disposed with the direction of arrow Z as an axis direction thereof is attached to the rear surface of the tilted portion 120A (the portion tilted to the lower-left side in the drawings) disposed in the upper side.

Accordingly, the second movable member 120 is rotatably supported. The second movable member 120 rotates (moves) along with the first movable member 116 by the retraction mechanism. One end in the transverse direction (upstream in the moving direction) of the sealing member 108 is fixed to the upper end of the tilted portion 120A of the second movable member 120 by adhesion.

The sealing member 108 is formed of, for example, a transparent film having a rectangular shape in a plan view and is attached to the second movable member 120 so as to come in contact with the intermediate transfer belt 68 along an edge of the opening 104 upstream in the moving direction of the intermediate transfer belt 68.

The sealing member 108 is disposed so that the free end thereof (the end not attached to the second movable member 120) comes in contact with the intermediate transfer belt 68 when the retraction mechanism is disposed in the contact state and the cleaning blade 106 comes in contact with the intermediate transfer belt 68, whereby the gap between the housing 102 and the intermediate transfer belt 68 is sealed up.

The sealing member 108 is disposed below the cleaning blade 106 and the free end of the sealing member 108 is directed downstream in the moving direction of the intermediate transfer belt 68. Accordingly, the residual toner T on the intermediate transfer belt 68 is not scratched by the sealing member 108.

The first movable member 116, the spindle 118, the support plate 119, and the second movable member 120 constitute a part of the housing 102. The opening 104 is a part opened from the lower end of the support plate 119 to the upper end of the second movable member 120 in the housing 102.

The cleaning device 100 is connected to a suction unit 110 as an example of the suction unit that sucks the residual toner T on the intermediate transfer belt 68 into the housing 102. The suction unit 110 includes a suction fan unit 111 (see FIG. 2). A first filter 112 collecting dust including the residual toner T by an air flow formed by the suction unit 110 is disposed in the housing 102.

The first filter 112 is a fiber assembly and has a long rectangular shape along the length direction (the direction of arrow Z) of the housing 102. The first filter 112 is bonded to an attaching member 113 and is attached to the inside of the housing 102. The attaching member 113 is a frame member having plural openings of a rectangular through-hole arranged in the length direction of a rectangular plate and is tilted below the spindle 118 in the XY plane so that the lower part rather than the upper part goes apart from the intermediate transfer belt 68 and the opening 104.

By the partitioning with this attaching member 113, a suction path 115 having a substantially inverted triangular shape in the XY plane is formed in the length direction of the housing 102 on the right side of the housing 102 in FIG. 3B. In a side view (XY plane) of the housing 102, a pair of partition walls 114 and 117 is formed upright on the bottom wall 102A between the opening 104 and the first filter 112.

A transport auger 121 that has a configuration in which a blade 127 is formed in a spiral shape on the outer peripheral surface of a rotation shaft 125 with the direction of arrow Z as an axis direction thereof and that transports the residual toner T collected into the housing 102 to one end in the axis direction (in the length direction of the housing 102) by its rotation is disposed in the lower part of the housing 102 and between the pair of partition walls 114 and 117.

That is, a transmission gear 90 is coaxially attached to the back side in the direction of arrow Z of the rotation shaft 125 of the transport auger 121 and engages with a driving gear 92 disposed on the back side in the direction of arrow Z (which is indicated by a virtual line in FIGS. 3A and 3B and FIGS. 4A and 4B). By causing the controller 20 (see FIG. 1) to control a motor (not shown) that rotationally drives the driving gear 92, the transport auger 121 is made to rotate to transport the residual toner T collected into the housing 102 to the back side in the direction of arrow Z.

A cylindrical collecting path 123 is disposed on the back side in the direction of arrow Z of the housing 102 so that the residual toner T transported by the transport auger 121 flows to a collection tank (not shown). The pair of partition walls 114 and 117 and the transport auger 121 constitute an example of the developer transport unit.

As shown in FIGS. 3A to 5, a second filter 150 as an example of the filtration member that collects dust including the residual toner T is disposed between the first filter 112 (the suction path 115) and the transport auger 121 (upstream in the suction air flow from the first filter 112). The second filter 150 is also a fiber assembly and has a long rectangular shape along the length direction (the direction of arrow Z) of the housing 102. The second filter 150 is attached to an attaching member 152 by adhesion.

The attaching member 152 is an example of the ladder-shaped frame body in which plural openings 153 of a substantially rectangular through-hole are formed in the length direction of a rectangular plate member, that is, which has a pair of horizontal frames 152A long in the length direction of the housing 102 and plural vertical frames 152B disposed to connect the horizontal frames 152A. The second filter 150 is attached to the attaching member 152, whereby the second filter 150 is exposed from the openings 153.

The lower part of the attaching member 152 is attached to the outer surface (the surface facing the first filter 112) of the partition wall 117 facing the first filter 112 by adhesion. At least the upper part of the attaching member 152, that is, the upper part including the upper half of the openings 153 exposing the second filter 150, is tilted forward so as to overlap with the transport auger 121 (blade 127) and the partition wall 117 (developer transport unit) in a plan view.

Hooks 154 as an example of the sliding portion extending toward the transport auger 121 are formed to protrude from the upper parts of the vertical frames 152B (the horizontal frame 152A extending upward from the vertical frames 152B) of the attaching member 152. The plural hooks 154 extend up to the position capable of interfering with the blade 127 of the transport auger 121 and are pushed up by the blade 127 when the blade 127 moves by the rotation of the transport auger 121.

When the hooks 154 are pushed up by the blade 127, the upper part of the attaching member 152 is elastically deformed to rise upright to the first filter 112. Thereafter, the hooks 154 are separated from the blade 127, the upper part is rapidly restored (dropped) (see FIGS. 8A to 8C). Accordingly, the second filter 150 (the attaching member 152) vibrates vertically and the residual toner T captured by the second filter 150 is dropped onto the transport auger 121.

A regulating member 156 formed of rubber or the like that regulates the elastic deformation of the attaching member 152 for the second filter 150 is disposed between the upper part of the second filter 150 (the attaching member 152) and the first filter 112 (the attaching member 113). Accordingly, the positions of the hooks 154 of the attaching member 152 relative to the blade 127 of the transport auger 121 are properly maintained.

Figure 5:
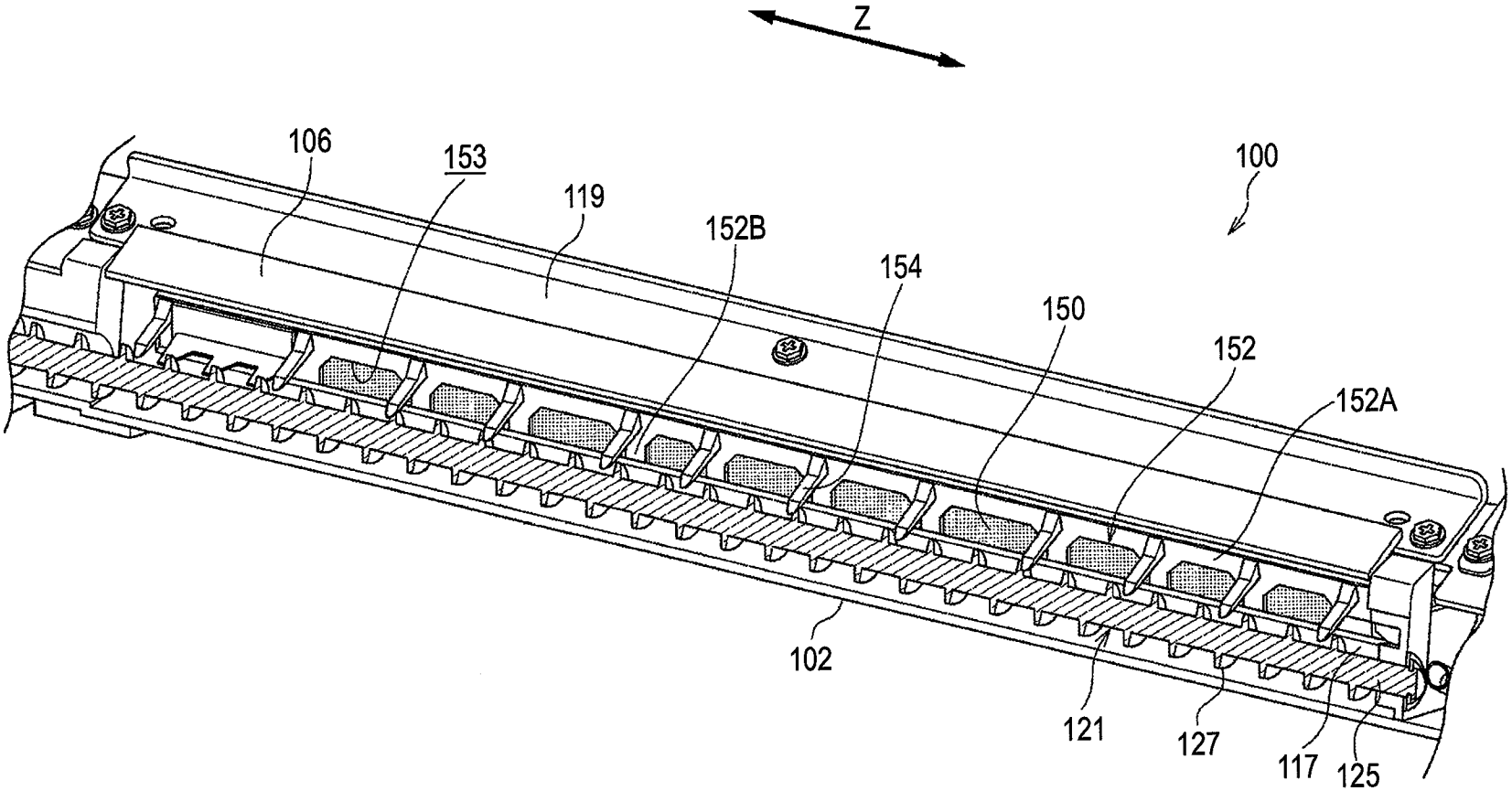
FIG. 5 is a perspective view illustrating a second filter of the cleaning device.
Figure 6:
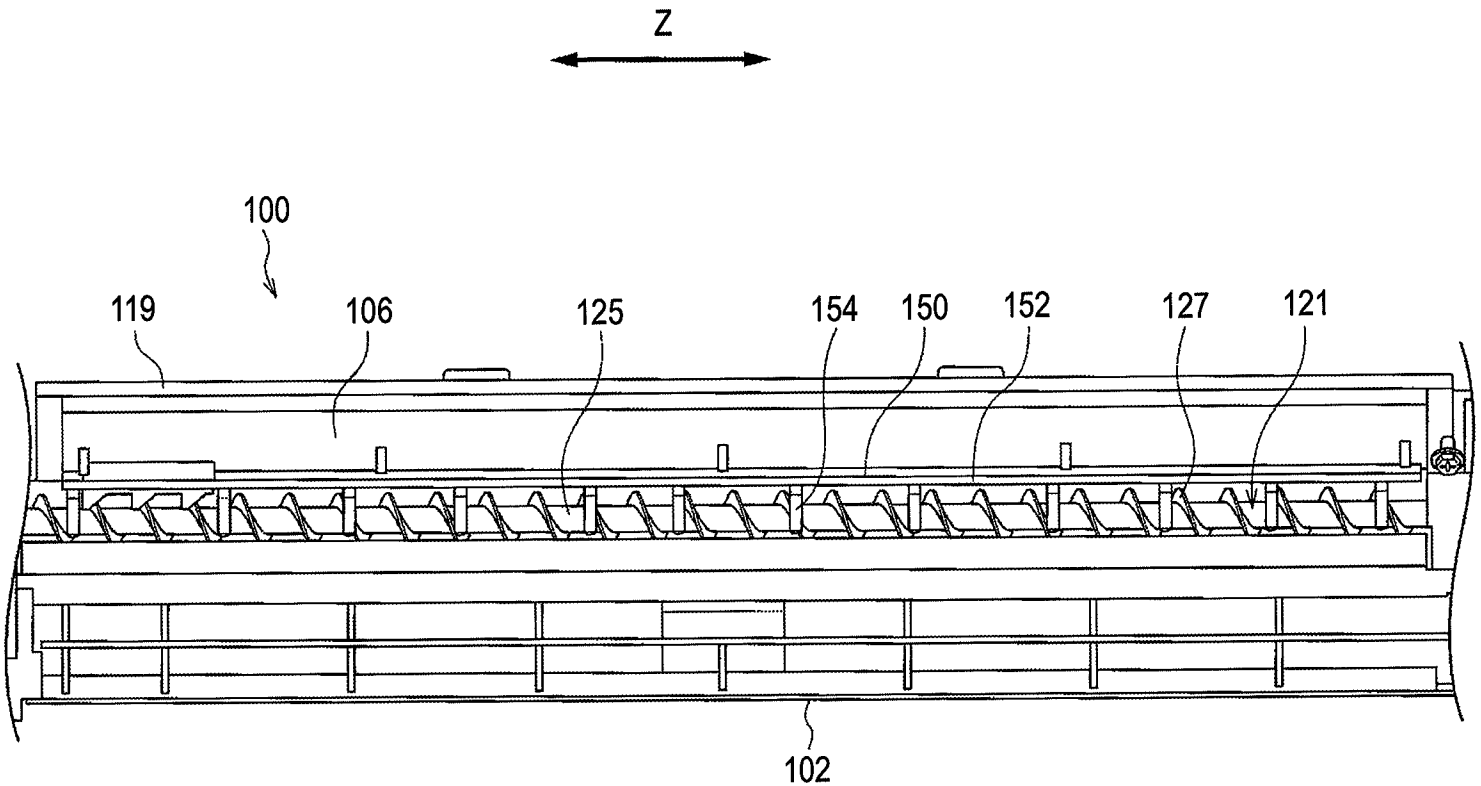
FIG. 6 is a plan view illustrating hooks protruding from the second filter of the cleaning device.
Figure 7:
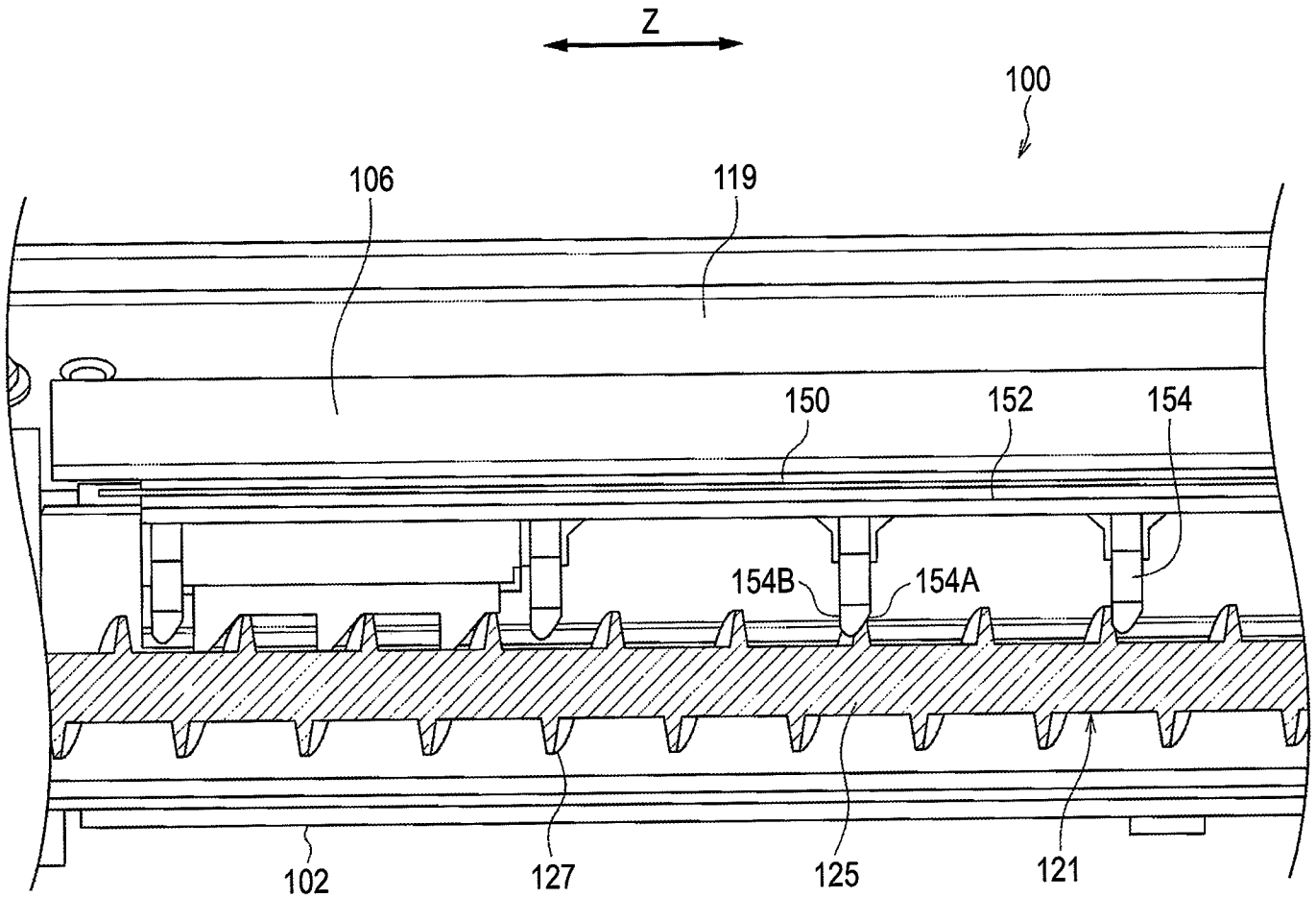
FIG. 7 is a plan view illustrating hooks protruding from the second filter and a transport auger of the cleaning device.

The sizes of the openings 153 of the attaching member 152 are different in the length direction as shown in FIG. 5. Accordingly, as shown in FIGS. 6 and 7, the intervals of the hooks 154 are not constant but are set so that the positions of the blade 127 do not coincide with (are different from) the positions of some hooks 154 in the state where the rotation of the transport auger 121 is stopped.

Accordingly, the second filter 150 (the attaching member 152) is configured to vibrate vertically at different times in the length direction (from the front side to the back side). That is, the intervals between the hooks 154 are determined so that they have different pushing times in the length direction.

Figure 8A:
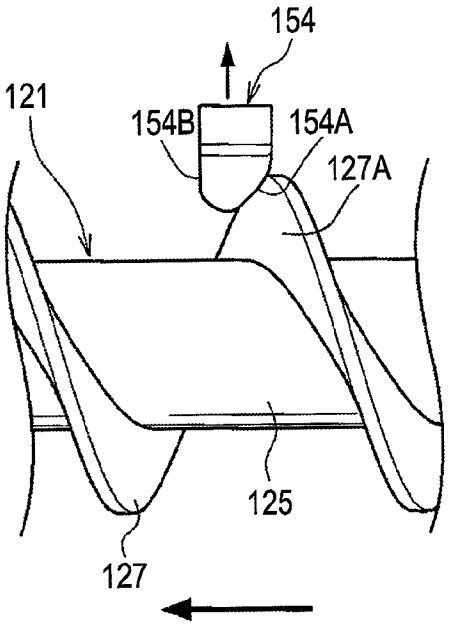
FIGS. 8A to 8C are diagrams illustrating a state where a hook is pushed up by a blade of the transport auger.
Figure 8B:
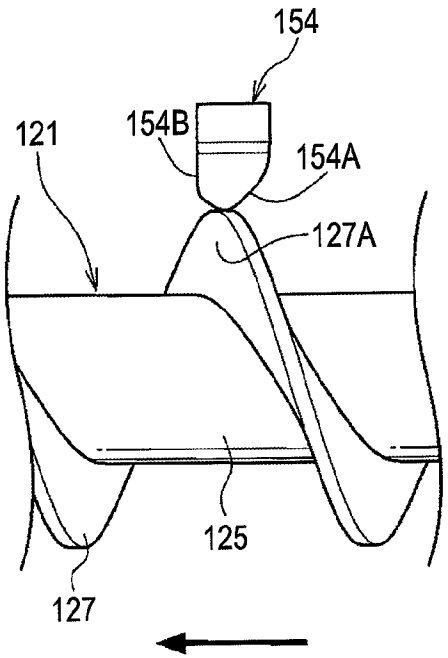
Figure 8C:
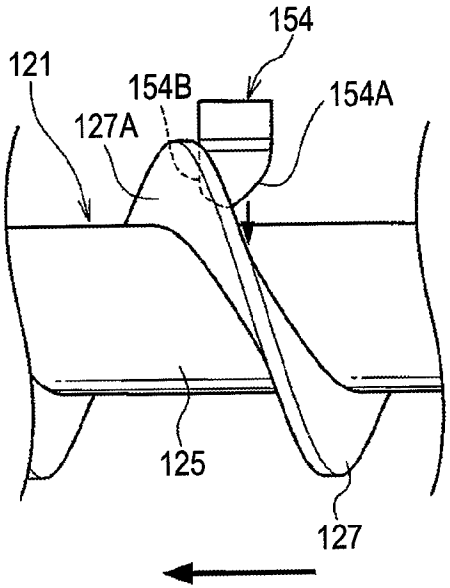

As shown in FIG. 7 and FIGS. 8A to 8C, the surface of each hook 154 upstream in the toner transport direction and coming in contact with the blade 127 is a tilted surface 154A substantially corresponding to the shape of the transport surface 127A of the blade 127 (for example, tilted by 45° about the axis direction of the rotation shaft 125 in FIGS. 8A to 8C), when the transport auger 121 (the rotation shaft 125) normally rotates to transport the residual toner T collected into the housing 102 to the collection tank. The surface of each hook 154 downstream in the toner transport direction is a vertical surface 154B substantially along the vertical direction (close to 90° about the axis direction of the rotation shaft 125).

Accordingly, the blade 127 of the transport auger 121 at the time of normally rotating comes in smooth contact with the hooks 154 without being locked to the hooks 154 so as to push up the hooks 154 (to elastically deform the attaching member 152). When the blade 127 is separated from the hooks 154, the hooks 154 are rapidly restored (dropped) to the original state (position), whereby the second filter 150 (the attaching member 152) is made to greatly vibrate.

In this way, at the time of rotation of the transport auger 121, the hooks 154 are pushed up (the attaching member 152 is elastically deformed) by the blade 127. At this time, a reaction force J (see FIGS. 3A and 3B and FIGS. 4A and 4B) directed substantially to the down side (in the downward direction perpendicular to the direction in which the hooks 154 extend in the XY plane) is relatively added to the transport auger 121 from the hooks 154.

The driving gear 92 engaging with the transmission gear 90 is disposed on a side in a direction not parallel to the direction in which it disengages from the transmission gear 90 disposed coaxially to the rotation shaft 125 of the transport auger 121 by the reaction force J, for example, on a side in the downward direction (below the second movable member 120) perpendicular to the direction in which the reaction force J is applied. Accordingly, the poor engagement of the transmission gear 90 and the driving gear 92 (the irregular rotation of the rotation shaft 125) is not caused.

The operation in this exemplary embodiment will be described below. An image forming procedure in the image forming apparatus 10 will be first described.

As shown in FIG. 1, when the image forming apparatus 10 is activated, color image data of yellow (Y), magenta (M), cyan (C), black (K), the first special color (E), and the second special color (F) are sequentially output to the exposure device 66 from an image processing device (not shown) or an external device. At this time, for example, the developing device 70 rotates and is maintained so that the developing unit 72Y (see FIG. 2) faces the outer peripheral surface of the photosensitive member 62.

As shown in FIGS. 4A and 4B, the cleaning blade 106 and the sealing member 108 of the cleaning device 100 are separated from the outer peripheral surface of the intermediate transfer belt 68 by the retraction mechanism until color toner images are multiply (primarily) transferred to the intermediate transfer belt 68 and are secondarily transferred onto the recording sheet P.

Subsequently, light emitted from the exposure device 66 on the basis of the image data is applied to the outer peripheral surface of the photosensitive member 62 charged by the charging member 64 to form an electrostatic latent image corresponding to the yellow image data on the outer peripheral surface of the photosensitive member 62. The electrostatic latent image formed on the outer peripheral surface of the photosensitive member 62 is developed into a yellow toner image by the developing unit 72Y. Then, the yellow toner image on the outer peripheral surface of the photosensitive member 62 is transferred to the intermediate transfer belt 68 by the primary transfer roller 67.

Subsequently, as shown in FIG. 1, the developing device 70 rotates by 60° in the direction of arrow +R and the developing unit 72M faces the outer peripheral surface of the photosensitive member 62. The charging, exposing, and developing processes are performed thereon and a magenta toner image on the outer peripheral surface of the photosensitive member 62 is transferred onto the yellow toner image on the intermediate transfer belt 68 by the primary transfer roller 67. In this way, the toner images of cyan (C), black (K), in addition to the first special color (E) and the second special color (F) if the colors are set, are sequentially and multiply transferred onto the intermediate transfer belt 68.

On the other hand, a recording sheet P sent out from the sheet receiving section 12 and carried through the carrying path 28 is carried to the secondary transfer position in synchronization with the multiple transfer of the toner images to the intermediate transfer belt 68 by the registration roller 38. The toner images multiply transferred onto the intermediate transfer belt 68 are secondarily transferred onto the recording sheet P carried to the secondary transfer position by the secondary transfer roller 71.

After the secondary transfer, as shown in FIGS. 3A and 3B, the cleaning blade 106 and the sealing member 108 of the cleaning device 100 come in contact with the outer peripheral surface of the intermediate transfer belt 68 by the retraction mechanism. Then, the residual toner T attached to the outer peripheral surface of the intermediate transfer belt 68 is detached by the cleaning blade 106 and is collected into the housing 102.

Subsequently, the recording sheet P to which the toner images have been transferred is carried in the direction of arrow A (to the right side in the drawing) to the fixing device 80. The toner images are heated and pressurized by the heating roller 82 and the pressurizing roller 84 of the fixing device 80 and are thus fixed onto the recording sheet P. The recording sheet P to which the toner images have been fixed is discharged, for example, to the sheet discharge section 15.

When images are formed on both sides of the recording sheet P, the recording sheet P of which the surface has been subjected to the fixing operation by the fixing device 80 is carried to the inversion section 33 in the direction of arrow −V and is carried in the direction of arrow +V, whereby the leading edge and the trailing edge of the recording sheet P are inverted. Then, the recording sheet P is carried in the direction of arrow B (to the left side in the drawing) along the inverse carrying path 29 and is carried to the carrying path 28. The rear surface of the recording sheet P is subjected to an image forming process (at this time, the cleaning blade 106 and the sealing member 108 are in the retracted state) and a fixing process.

After the fixing process, the cleaning blade 106 and the sealing member 108 come in contact with the outer peripheral surface of the intermediate transfer belt 68 by the retraction mechanism. Then, the residual toner T attached to the outer peripheral surface of the intermediate transfer belt 68 is detached and collected into the housing 102 by the cleaning blade 106.

The operation of the cleaning device 100 will be described below.

Figure 9A:
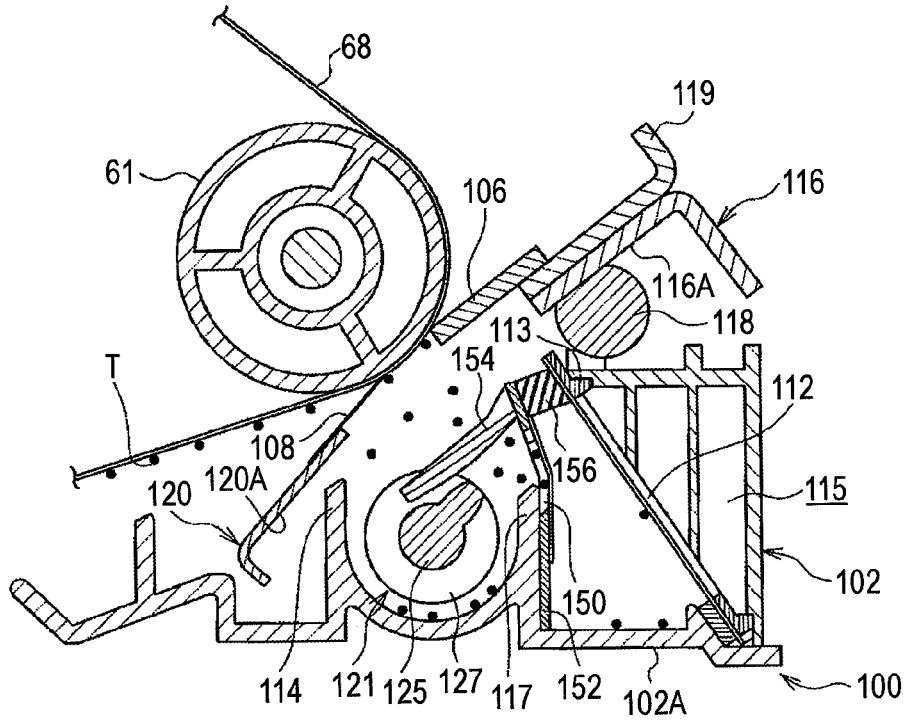
FIG. 9A is a sectional view illustrating a state where residual toner is collected at the time of coming in contact with the intermediate transfer belt and FIG. 9B is a sectional view illustrating a state where residual toner is collected at the time of being separated from the intermediate transfer belt.

After the secondary transfer to the recording sheet P, as shown in FIG. 9A, the residual toner T not transferred but remaining is attached to the outer peripheral surface of the intermediate transfer belt 68. By the circular movement of the intermediate transfer belt 68 in the direction of −R, the residual toner T is carried to the cleaning device 100 and is collected into the housing 102 by the free end of the cleaning blade 106 in contact with the outer peripheral surface of the intermediate transfer belt 68.

At this time, the free end of the sealing member 108 comes in contact with the outer peripheral surface of the intermediate transfer belt 68 to air-tightly seal the gap between the housing 102 and the intermediate transfer belt 68. Accordingly, the residual toner T collected into the housing 102 is prevented from leaking to the outside of the housing 102. Since the free end of the sealing member 108 is directed downstream in the moving direction of the intermediate transfer belt 68, the residual toner T is not scratched by the sealing member 108. At this time, the transport auger 121 is rotationally driven and the suction unit 110 (the fan unit 111) is also driven.

Figure 9B:
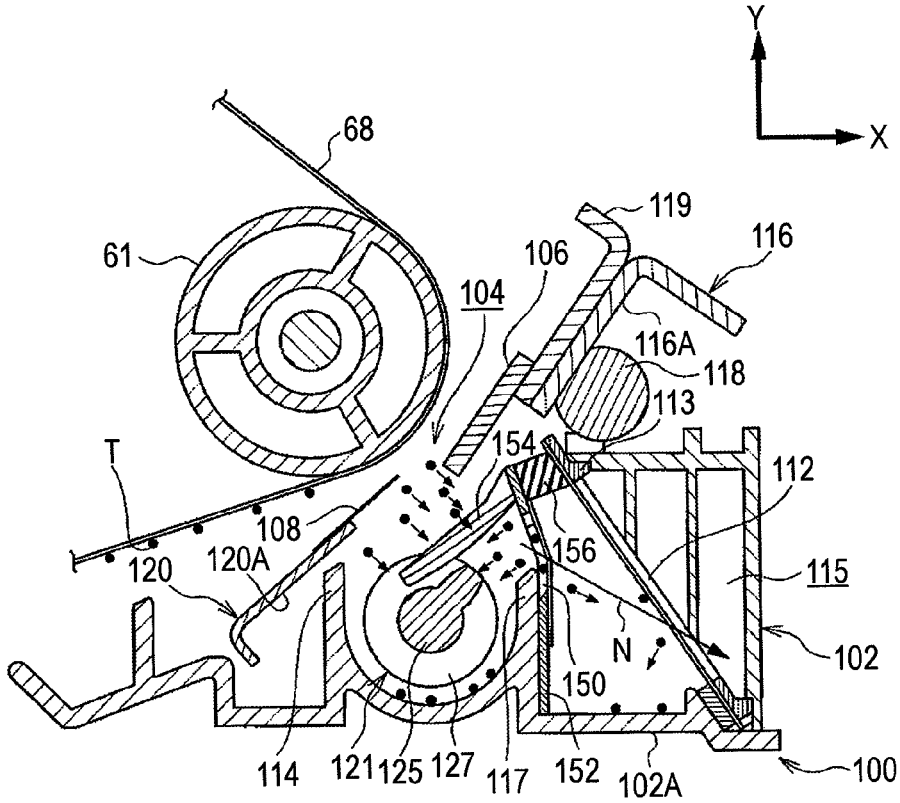

Subsequently, when the image forming apparatus 10 performs a next image forming procedure, as shown in FIG. 9B, the free end of the cleaning blade 106 and the free end of the sealing member 108 enter the retracted state where they are separated from the outer peripheral surface of the intermediate transfer belt 68. At this time, the rotational driving of the transport auger 121 is stopped but the driving of the suction unit 110 (the fan unit 111) is kept.

Accordingly, the suction path 115 and the housing 102 are in the negative-pressure state and air is sucked from the housing 102 to the suction path 115. Therefore, an air flow in the direction of arrow N (see FIG. 9B) is formed from the opening 104 to the second filter 150 and the first filter 112 and the residual toner T collected into the housing 102 is prevented from being re-attached (scattered) to the outer peripheral surface of the intermediate transfer belt 68.

The residual toner T flowing along with the air flow is captured by the second filter 150 or is contacted and dropped by the second filter 150 or the attaching member 152. The residual toner T passing through the second filter 150 is captured by the first filter 112 or is contacted and dropped by the first filter 112 or the attaching member 113.

That is, since the upper part of the second filter 150 is tilted forward so as to overlap with the partition wall 117 and the transport auger 121 in a plan view, apart of the residual toner T collected from the opening 104 comes in contact with the second filter 150 or the attaching member 152 and is dropped on the transport auger 121, or is once captured and then dropped by the second filter 150. Accordingly, it is possible to reduce the amount of residual toner T captured by the second filter 150 and to reduce the clogging of the second filter 150.

Since the first filter 112 is also tilted in the housing 102 (tilted forward), the area thereof is great and the captured residual toner T is easily dropped, compared with the configuration in which the first filter is disposed upright in the housing 102. Accordingly, the residual toner T passing through the second filter 150 is captured by the first filter 112 or is dropped and stored on the bottom wall 102A of the housing 102 between the second filter 150 and the first filter 112.

Since a part of the residual toner T is captured by the second filter 150, the amount of residual toner T flowing to the first filter 112 is reduced and the clogging of the first filter 112 is reduced. Accordingly, it is possible to suppress the decrease in suction force of the residual toner T by the suction unit 110, thereby extending the lifetime of the cleaning device 100.

As shown in FIG. 9A, when the free end of the cleaning blade 106 and the free end of the sealing member 108 comes in contact with the outer peripheral surface of the intermediate transfer belt 68 again, the transport auger 121 is rotationally driven. That is, the residual toner T collected into the housing 102 is transported by the transport auger 121.

At this time, as shown in FIGS. 8A and 8B, the blade 127 pushes up the hooks 154 to elastically deform the attaching member 152 so as to rise upright with the rotation of the transport auger 121. Thereafter, as shown in FIG. 8C, the blade 127 is separated from the hooks 154 and the attaching member 152 (the hooks 154) are rapidly restored (dropped) to the original state. Accordingly, the second filter 150 (the attaching member 152) vibrates vertically.

Accordingly, the residual toner T captured by the second filter 150 is dropped on the transport auger 121 due to the vibration, thereby further reducing the clogging of the second filter 150. The vibrating times are different between the front side and the back side (for example, the vibration is caused with a time difference from the front side to the back side) in the length direction of the second filter 150 (the attaching member 152), so that some hooks 154 do not interfere with the blade 127 of the transport auger 121 when some hooks 154 interfere with the blade 127 of the transport auger 121.

Accordingly, it is possible to cause the second filter 150 (the attaching member 152) to efficiently vibrate and to reduce the strange noise due to the vibration, compared with the configuration in which the second filter 150 (the attaching member 152) is caused to simultaneously vibrate through the overall range of the length direction (on the front side and the back side). In the formed images, the formation of the banding (so-called white streaks) due to the vibration is also suppressed.

Since the surface of each hook 154 upstream in the toner transport direction and coming in contact with the blade 127 at the time of normal rotation of the transport auger 121 is the tilted surface 154A substantially corresponding to the transport surface 127A of the blade 127, the blade 127 of the transport auger 121 can come in smooth contact with the hooks 154 without being locked to the hooks 154, thereby pushing up the hooks 154.

The hooks 154 are formed to protrude from the upper part (in the extension line) of the vertical frames 152B of the attaching member 152. Accordingly, when the hooks 154 are pushed up by the blade 127, the bending (the elastic deformation) of the attaching member 152 is suppressed or prevented. That is, the rigidity of the attaching member 152 when the hooks 154 are pushed up by the blade 127 is guaranteed. Therefore, compared with the configuration in which the hooks 154 are not formed to protrude from the upper part of the vertical frames 152B of the attaching member 152, it is possible to cause the second filter 150 (the attaching member 152) to vibrate greatly.

With the normal rotation of the transport auger 121, the surface of the hook 154 downstream in the toner transport direction and being separated from the blade 127 is the vertical surface 154B substantially along the vertical direction. Accordingly, when the hook 154 is separated from the blade 127, the attaching member 152 (the hook 154) is rapidly restored (dropped) to the original state. Therefore, the second filter 150 (the attaching member 152) vibrates as greatly as possible.

The driving gear 92 engaging with the transmission gear 90 disposed coaxially to the rotation shaft 125 of the transport auger 121 is disposed in the lower side in the direction perpendicular to the direction of the reaction force J relatively applied by the hooks 154 when the hooks 154 are pushed up by the blade 127 of the transport auger 121.

Here, when the driving gear 92 is disposed above the transmission gear 90, the transport auger 121 (the rotation shaft 125) is relatively pushed downward by the hooks 154, whereby the transmission gear 90 and the driving gear 92 may disengage from each other. When the engagement depth of the transmission gear 90 and the driving gear 92 is made to increase so as not to disengage from each other, there is a problem in that the torque necessary for the rotational driving increases.

However, in this exemplary embodiment, since the driving gear 92 is disposed at the above-mentioned position, the engagement depth of the driving gear 92 and the transmission gear 90 is not influenced. That is, the transmission gear 90 and the driving gear 92 do not disengage from each other and the torque necessary for the rotational driving does not increase.

While the cleaning device 100 according to this exemplary embodiment has been described with reference to the drawings, the cleaning device 100 according to this exemplary embodiment is not limited to the shown drawings, but may be variously modified in design without departing from the concept of the invention.

For example, the housing 102 is not limited to the configuration in which it is fixed to the image forming apparatus 10, but the entire housing 102 may be brought into contact with and separated from the intermediate transfer belt 68 and the cleaning blade 106 and the sealing member 108 may be brought into contact with and separated from the outer peripheral surface of the intermediate transfer belt 68.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explaining the principles of the invention and its practical applications, thereby enabling others skilled in the art to understand the invention for a variety of embodiments and with the various modifications as are suited to the particular use contemplated. It is intended that the scope of the invention is defined by the following claims and their equivalents.

What is claimed is:

1. A developer collecting device comprising:

a housing in which an opening disposed opposite to a developer holding member with developer held thereon is formed to extend in a direction perpendicular to a moving direction of the developer holding member;

a collection member comprising a blade with a free end that is disposed along an edge of the opening downstream in the moving direction, is capable of coming in contact with and being separated from the developer holding member, and that removes the developer from an outer peripheral surface and collects the detached developer in the housing when coming in contact with the outer peripheral surface of the developer holding member;

a sealing member that is disposed along an edge of the opening upstream in the moving direction, is capable of coming in contact with and being separated from the developer holding member, and that seals up a gap between the developer holding member and the housing at the time of coming in contact with the outer peripheral surface of the developer holding member;

a suction passage that is formed in a longitudinal direction of the housing; a developer transport unit comprising a rotating blade attached around a rotation shaft thereof in a spiral shape that transports the developer collected into the housing to one end in the longitudinal direction of the housing; and a filtration member that is disposed between the developer transport unit and the suction passage, extends in the longitudinal direction of the housing, and that is tilted so that at least an upper part thereof overlaps with an upside of the developer transport unit, wherein the collection member is disposed above the rotation shaft of the developer transport unit and the suction passage is disposed next to the rotation shaft of the developer transport unit, and wherein the developer transport unit has a configuration in which a sliding portion coming in slidable contact with the rotating blade is disposed on the upper part of the filtration member.

2. The developer collecting device according to claim 1, wherein the sliding portion is pushed up and dropped by the rotating blade to cause the filtration member to oscillate in a vertical direction.

3. The developer collecting device according to claim 2, wherein a surface of the sliding portion coming in contact with the rotating blade has a slope along a transport surface of the rotating blade.

4. The developer collecting device according to claim 2, further comprising:

a transmission gear that is disposed coaxially to the rotation shaft of the developer transport unit; and a driving gear that engages with the transmission gear and transmits rotary power to the transmission gear when engaged with the transmission gear, wherein the driving gear is disposed on one side in a direction not parallel to a direction in which the driving gear disengages from the transmission gear with a reaction force from the sliding portion as viewed in an axis direction of the rotation shaft.

5. The developer collecting device according to claim 2, wherein the filtration member is disposed in a ladder-shaped frame body including a pair of horizontal frames extending in the longitudinal direction of the housing and a plurality of vertical frames disposed to connect the pair of horizontal frames, and wherein the sliding portion is disposed on an upper part of the vertical frames.

6. The developer collecting device according to claim 2, wherein a plurality of the sliding portions are arranged in a longitudinal direction of the filtration member and intervals thereof are determined so that times of pushing up the sliding portions are different in the longitudinal direction.

7. The developer collecting device according to claim 1, wherein the filtration member is tilted away from a vertical direction so that at least an upper part thereof overlaps with the upside of the developer transport unit.

8. An image forming apparatus comprising:

a latent image holding member that holds a latent image;

a developing unit that develops the latent image on the latent image holding member with developer to form a developer image;

a developer holding member to which the developer image on the latent image holding member is transferred and that holds the transferred developer image;

a transfer unit that transfers the developer image on the developer holding member onto a recording medium;

a housing in which an opening disposed opposite to the developer holding member with developer held thereon is formed to extend in a direction perpendicular to a moving direction of the developer holding member;

a collection member comprising a blade with a free end that is disposed along an edge of the opening downstream in the moving direction, is capable of coming in contact with and being separated from the developer holding member, and that removes the developer from an outer peripheral surface and collects the detached developer in the housing when coming in contact with the outer peripheral surface of the developer holding member;

a sealing member that is disposed along an edge of the opening upstream in the moving direction, is capable of coming in contact with and being separated from the developer holding member, and that seals up a gap between the developer holding member and the housing at the time of coming in contact with the outer peripheral surface of the developer holding member;

a suction passage that is formed in a longitudinal direction of the housing;

a developer transport unit comprising a rotating blade attached around a rotation shaft thereof in a spiral shape that transports the developer collected into the housing to one end in the longitudinal direction of the housing; and a filtration member that is disposed between the developer transport unit and the suction passage, extends in the longitudinal direction of the housing, and that is tilted so that at least an upper part thereof overlaps with an upside of the developer transport unit, wherein the collection member is disposed above the rotation shaft of the developer transport unit and the suction passage is disposed next to the rotation shaft of the developer transport unit, and wherein the developer transport unit has a configuration in which a sliding portion coming in slidable contact with the rotating blade is disposed on the upper part of the filtration member.

9. A developer collecting device comprising:

a housing in which an opening disposed opposite to a developer holding member and is formed to extend in a direction perpendicular to a moving direction of the developer holding member;

a suction passage formed in the housing;

a developer transport unit comprising a rotating blade attached around a rotation shaft thereof that transports the developer collected into the housing to one end in the longitudinal direction of the housing;

a filtration member that is disposed between the developer transport unit and the suction passage, extends substantially vertically in the longitudinal direction of the housing, and is tilted so that at least an upper part thereof overlaps with an upside of the developer transport unit, wherein the developer transport unit has a configuration in which a sliding portion coming in slidable contact with the rotating blade is disposed on the upper part of the filtration member.

* * * * *